US010927803B2

(12) United States Patent
Saito et al.

(10) Patent No.: US 10,927,803 B2
(45) Date of Patent: Feb. 23, 2021

(54) FUEL INJECTION VALVE

(71) Applicant: Hitachi Automotive Systems, Ltd., Hitachinaka (JP)

(72) Inventors: Takahiro Saito, Hitachinaka (JP); Nobuaki Kobayashi, Hitachinaka (JP); Akihiro Yamazaki, Hitachinaka (JP); Eiji Tamura, Hitachinaka (JP)

(73) Assignee: Hitachi Automotive Systems, Ltd., Hitachinaka (JP)

( * ) Notice: Subject to any disclaimer, the term of this patent is extended or adjusted under 35 U.S.C. 154(b) by 0 days.

(21) Appl. No.: 16/082,836

(22) PCT Filed: Feb. 16, 2017

(86) PCT No.: PCT/JP2017/005642

§ 371 (c)(1),
(2) Date: Sep. 6, 2018

(87) PCT Pub. No.: WO2017/159197

PCT Pub. Date: Sep. 21, 2017

(65) Prior Publication Data

US 2019/0101087 A1 Apr. 4, 2019

(30) Foreign Application Priority Data

Mar. 14, 2016 (JP) ..... JP2016-049221

(51) Int. Cl.
*F02M 51/06* (2006.01)
*F02M 61/16* (2006.01)
*F02M 61/18* (2006.01)

(52) U.S. Cl.
CPC ..... *F02M 51/0667* (2013.01); *F02M 61/162* (2013.01); *F02M 61/188* (2013.01);
(Continued)

(58) Field of Classification Search
CPC ..... F02M 51/0667; F02M 61/162; F02M 61/1853; F02M 61/188; F02M 51/0639; F02M 61/168
(Continued)

(56) References Cited

U.S. PATENT DOCUMENTS 6,854,670 B2 * 2/2005 Sumisha ..... F02M 51/0678 239/468
7,828,232 B2 * 11/2010 Oomori ..... F02M 51/061 239/585.1
(Continued)

FOREIGN PATENT DOCUMENTS

JP 2012-215135 A 11/2012
JP 2013-24176 A 2/2013
(Continued)

OTHER PUBLICATIONS

International Search Report (PCT/ISA/210) issued in PCT Application No. PCT/JP2017/005642 dated Mar. 28, 2017 with English translation (two (2) pages).
(Continued)

*Primary Examiner* — Steven J Ganey
(74) *Attorney, Agent, or Firm* — Crowell & Moring LLP

(57) ABSTRACT

In the present invention, two side-section side surfaces and each horizontal passage run along a fuel flow direction and have a linear section, and an end-section side surface formed between the two side-section side surfaces and forming an upstream-side end portion has a curved section connected to the side-section side surfaces and. When a fuel inlet and the horizontal passages are projected onto a plane perpendicular to a valve axial center, a projected line of the linear section of each of the horizontal passages extends to a place intersecting a projected line of the opening edge of the fuel inlet, and the upstream-side end portion of each of the horizontal passages extends toward the inside of the opening edge.

4 Claims, 7 Drawing Sheets

(52) U.S. Cl.
CPC ..... *F02M 61/1853* (2013.01); *F02M 51/0639* (2013.01); *F02M 61/168* (2013.01)

(58) Field of Classification Search
USPC ..... 239/468, 491–494, 533.12, 584, 585.1, 239/585.4, 585.5, 601
See application file for complete search history.

(56) References Cited

U.S. PATENT DOCUMENTS

| | | | | |
|---|---|---|---|---|
| 2012/0247427 | A1 | 10/2012 | Saito et al. | |
| 2013/0026256 | A1 | 1/2013 | Okamoto et al. | |
| 2013/0206870 | A1* | 8/2013 | Saito ..... | F02M 61/1806 239/494 |
| 2014/0251262 | A1 | 9/2014 | Okamoto et al. | |

FOREIGN PATENT DOCUMENTS

| | | | |
|---|---|---|---|
| JP | 2014-173479 | A | 9/2014 |
| JP | 2014-214682 | A | 11/2014 |

OTHER PUBLICATIONS

Japanese-language Written Opinion (PCT/ISA/237) issued in PCT Application No. PCT/JP2017/005642 dated Mar. 28, 2017 (four (4) pages).

* cited by examiner

FUEL INJECTION VALVE

TECHNICAL FIELD

The present invention relates to a fuel injection valve which generates swirl fuel on the upstream sides of fuel injection holes and injects the swirl fuel from the fuel injection holes.

BACKGROUND TECHNOLOGY

As a background technology of the present technical field, a fuel injection valve has been known which is described in a Japanese Patent Application Publication No. 2012-215135 (patent document 1). This fuel injection valve includes: a valve body swingably provided; a valve seat member in which a valve seat on which the valve body is seated at the time of valve closing and which has an opening part on the downstream side of the valve seat; swirl imparting chambers for imparting swirling force to fuel by making swirl to the fuel inside them; injection holes which are formed on the bottoms of the swirl imparting chambers; and communication passages which communicate the swirl imparting chambers with the opening part of the valve seat member. When the diameter of the swirl imparting chamber is D, the width of the communication passage is W, they are formed to satisfy the equation $0.15\ W/D<0.5$ (see abstract). In addition, in this fuel injection valve, three sets of fuel passages each formed of a swirl imparting chamber, a communication passage and a fuel injection hole are provided in a nozzle plate, and each of three sets of fuel communication passages is connected to each other in a central chamber formed in the vicinity of the center of the nozzle plate (see paragraph [0015]).

In addition, in a Japanese Patent Application Publication No. 2014-173479, a fuel injection valve has been described which includes swirling chambers each having an inner peripheral wall whose curvature is gradually larger from upstream to downstream, paths for swirling each of which, having a fuel flow-in region formed along a valve axis direction, guides fuel to the associated one of the swirling chambers, and fuel injection orifices open into the associated swirling chambers, respectively, and a curved portion in the fuel injection valve is formed on the bottom of an inlet portion of each of the paths for swirling so as to change the fuel flow (see abstract). In this fuel injection valve, an orifice plate (corresponding to the nozzle plate of the patent document 1) has four paths for swirling which extend radially outwardly from the center of the orifice plate while being circumferentially equidistantly spaced from one another (to be 90 degrees apart) (see paragraphs [0023] and [0024]).

PRIOR ART DOCUMENT

Patent Document

Patent Document 1: Japanese Patent Application Publication 2012-215135

Patent Document 2: Japanese Patent Application Publication 2014-173479

SUMMARY OF THE INVENTION

Task to be Solved by the Invention

In the fuel injection valve of the patent document 1, since the three sets of the communication passages are connected in the vicinity of the center of the nozzle plate, the passage length of each of the communication passages becomes long. Consequently, the dead volume of a fuel passage formed on the downstream side of the valve seat becomes large. In contrast to this, in the fuel injection valve of the patent document 2, four sets of the paths for swirling are formed independent of each other, and thereby the length of a fuel passage formed on the downstream side of the valve seat can be shortened.

In the fuel injection valve of the patent document 2, as shown in, for example, FIG. 4 of the patent document 1, the end portion on the inlet side of each of the paths for swirling is formed in a arc shape. When the arc-shaped end portion (hereinafter, referred to as an arc-shaped portion), the paths for swirling and a fuel inlet (corresponding to the opening part of the valve member in the patent document 1) for introducing fuel into the paths for swirling are projected onto a plane perpendicular to a valve axis, the opening edge of the fuel inlet intersects the side walls of the paths for swirling at the connection parts in which the linear side wall of each of the paths for swirling is connected to the arc-shaped portion.

With this configuration, when the position between the valve seat member (in the patent document 2, it is referred to as a nozzle plate) formed with the fuel inlet and the orifice plate (nozzle plate) formed with the paths for swirling deviate is shifted, in a path for swirling, the opening edge of the fuel inlet intersects the arc-shaped portion, and the passage cross-sectional area of this path for swirling which faces the fuel inlet is changed at the arc-shaped portion. If the passage cross-sectional area facing the fuel inlet is changed at the arc-shaped portion, as compared with a case where it is changed at the linear section of the path for swirling, the rate of change in the passage cross-sectional area facing the fuel inlet to the amount of the position deviation between the valve seat and the nozzle plate becomes large, and variation in the flow amount of fuel flowing into a plurality of the paths for swirling (communication passages) becomes large.

An object of the present invention is to provide a fuel injection valve which is capable of suppressing variation in the fuel amount of fuel flowing into a plurality sets of communication passages (hereinafter, referred to as horizontal passages) even in a case where position variation occurs between a valve seat member and a nozzle plate.

Means for Solving the Task

To achieve above object, a fuel injection valve of the present invention includes:

fuel injection holes configured to inject fuel to an outside;

a valve body configured to open and close a fuel passage in cooperation with a valve seat, on upstream sides of the fuel injection holes;

a valve seat member formed with the valve seat; and a nozzle plate in which a plurality of swirl passages are formed and which is connected to a distal end surface of the valve seat member, wherein the swirl passages each include:

a swirl chamber for allowing fuel to be swirled to flow to a corresponding one of the fuel injection holes; and a horizontal passage which is connected to an upstream side of the swirl chamber and which supplies fuel to the swirl chamber, wherein the valve seat member is opened to the distal end surface to which the nozzle plate is connected and includes a fuel inlet which is connected to an upstream-side end portion of the horizontal passage and introduces fuel into the plurality of the swirl passages, wherein the horizontal passage includes two side-section side surfaces extending along a fuel flow direction and having a linear section, and includes, on an upstream side thereof, an end-section side surface which is formed between the two side-section side surfaces and which has a curved section connected to the linear section, wherein when the fuel inlet and the horizontal passage are projected onto a plane perpendicular to a valve axial center, a projected line of the linear section of the side-section side surfaces of the horizontal passage extends to a place intersecting a projected line of an opening edge of the fuel inlet, and the upstream-side end portion of the horizontal passage extends toward an inside of the opening edge, and wherein, in the plurality of the swirl passages, all of the swirl passages each have a distance dimension equal to 0 or larger between a connection place of the linear section and the curved section and the intersection place of the projected line of the opening edge of the fuel inlet and the projected line of the linear section, and at least one of the swirl passages has a distance dimension larger than 0 between the connection place of the linear section and the curved section and the intersection place of the projected line of the opening edge of the fuel inlet and the projected line of the linear section.

Effects of the Invention

According to the present invention, even if positional deviation occurs between the valve seat member and the nozzle plate, a change in the passage sectional area of the horizontal passages facing the fuel inlet can be small, and thereby a variation in the flow amount of the fuel flowing into a plurality of the horizontal passages can be suppressed.

MODE FOR IMPLEMENTING THE INVENTION

An embodiment of the present invention will be explained with reference to the drawings.

Figure 1:
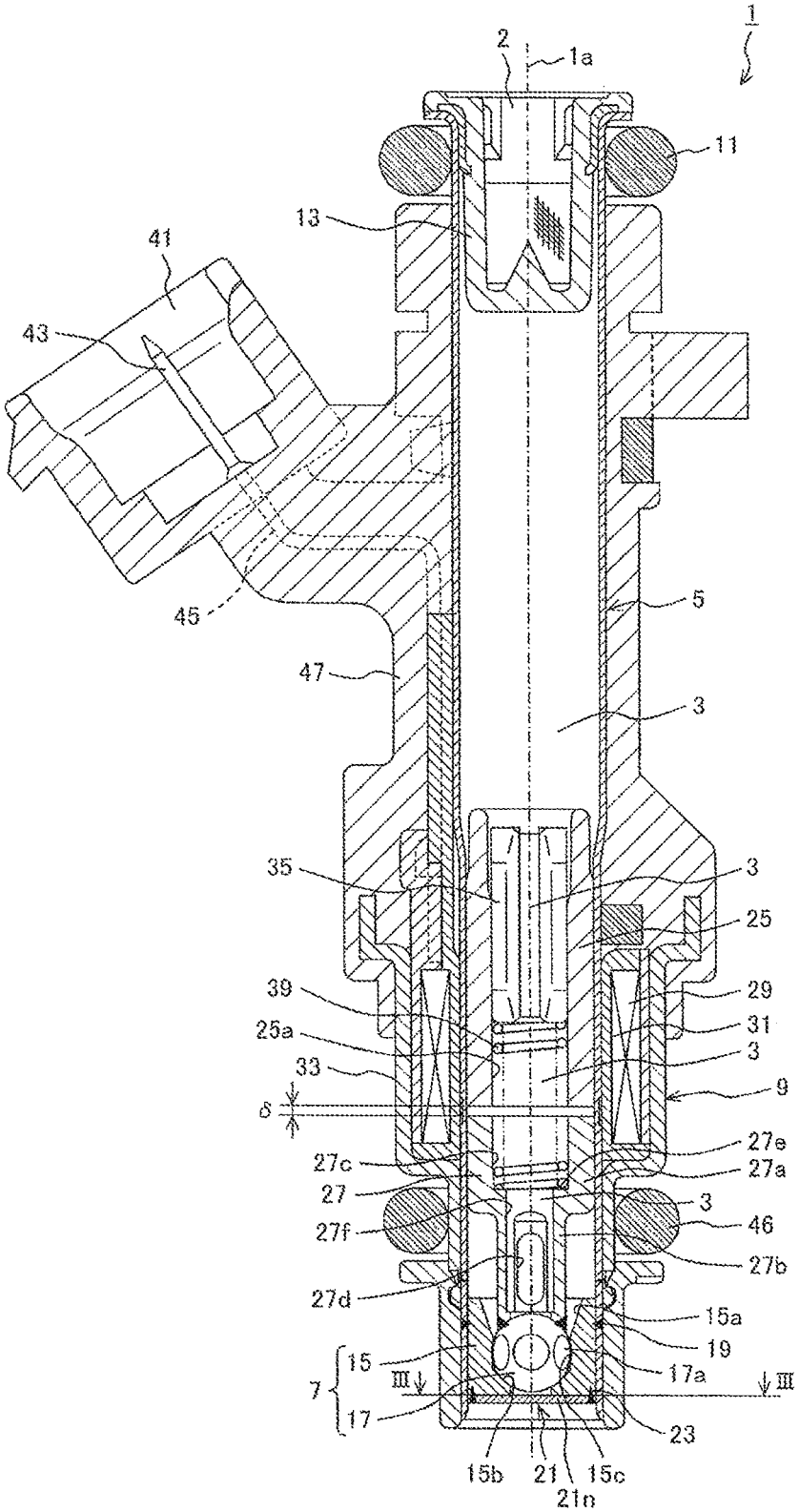
FIG. 1 is a sectional view showing a cross section along a valve axial center (central axis) la a fuel injection valve 1 according to the present invention.

The whole configuration of a fuel injection valve 1 will be explained with reference to FIG. 1. FIG. 1 is a sectional view showing a cross section along a valve axial center (central axis) la in the fuel injection valve 1 according to the present invention. The central axis 1*a* corresponds to the axis (valve axial center) of a movable element 27 provided integrally with the after-mentioned valve body 17, and to the central axis of the after-mentioned cylindrical body 5. In addition, the central axis 1*a* also corresponds to the central axis of the after-mentioned valve seat 15*b* and nozzle plate 21*n*.

The fuel injection valve 1 is provided with the cylindrical body 5 made of metal which extends from the upper end part to the lower end part of the fuel injection valve 1. The cylindrical body 5 is formed with, in the inside thereof, a fuel passage 3 substantially along the central axis 1*a*. In FIG. 1, the upper end part (upper end side) of the fuel injection valve 1 is referred as a base end part (base end side), and the lower end part (lower end side) of the fuel injection valve 1 is referred as a distal end part (distal end side). The terms "base end part (base end side)" and "distal end part (distal end side)" are based on the flow direction of fuel or on the fitting structure of the fuel injection valve 1 to a fuel pipe which is not shown in the drawings. That is, in the flow direction of fuel, the base end part is an upstream side and the distal end part is a downstream side. In addition, an up-and-down relation explained in the present specification is determined based on FIG. 1, and it is not related to a vertical direction of a mounting state of the fuel injection valve 1 on an internal combustion engine.

The cylindrical body 5 is provided with, at the base end part thereof, a fuel supply port 2. This fuel supply port 2 is provided with a fuel filter 13. The fuel filter 13 is a member to remove foreign substances mixed in fuel.

An O-ring 11 is disposed at the base end part of the cylindrical body 5. The O-ring 11 functions as a seal material when the fuel injection valve 1 is connected to the fuel pipe.

The cylindrical body 5 is formed with, at the distal end part thereof, a valve part 7 formed of the valve body 17 and a valve seat member 15. The valve seat member 15 is formed with a valve body accommodation hole 15*a* having a step to accommodate the valve body 17. A conical surface is formed in the middle of the valve body accommodation hole 15*a*, and the valve seat (seal part) 15*b* is formed on this conical surface. A guide surface 15*c* to guide the movement of the valve body 17 in a direction along the central axis 1*a* is formed at a part on the upstream side (base end side) more than the valve seat 15*b* of the valve accommodation hole 15*a*. The valve seat 15*b* performs the opening/closing of a fuel passage in cooperation with the valve body 17. The valve body 17 comes in contact with the valve seat 15*b*, and the fuel passage is closed. In addition, the valve body 17 is separated from the valve seat 15*b*, and the fuel passage is opened.

The valve seat member 15 is inserted into the inside on the distal end side of the cylindrical body 5, and is fixed to the cylindrical body 5 by laser welding. A laser welding 19 is formed over the entire circumference from the outer circumferential side of the cylindrical body 5. The valve body accommodation hole 15*a* penetrates through the valve seat member 15 in the direction along the central axis 1*a*. A nozzle plate 21*n* formed of a thin plate-shaped member is attached to the lower end surface (distal end surface, downstream-side end surface) of the valve seat member 15. The nozzle plate 21*n* closes the opening of the valve seat member 15 which is formed by the valve accommodation hole 15*a*.

In the present embodiment, the valve seat member 15 and the nozzle plate 21*n* form a fuel injection part 21 configured to inject swirl fuel. The nozzle plate 21*n* is fixed to the valve seat member 15 by laser welding. A laser welding portion 23 is formed around the circumference of an injection hole forming region at which fuel injection holes 220-1, 220-2, 220-3 and 220-4 (see FIG. 3) are formed, so as to surround this injection hole forming region. The valve seat member 15 may be fixed to the cylindrical body 5 by the laser welding after being press-fitted into the inside on the distal end side of the cylindrical body 5.

In the present embodiment, a ball valve having a spherical shape is used as the valve body 17. In the valve body 17, a part facing a guide surface 15*c* is provided with a plurality of notched surfaces 17*a* formed at intervals in a circumferential direction, and a gap is formed between the notched surfaces 17*a* and the inner circumferential surface of the valve seat member 15. By this gap, a fuel passage is formed. In addition, the valve body 17 can be formed by a valve body other than the ball valve. For example, a needle valve may be used.

In the present embodiment, the valve part 7 including the valve seat member 15 and the valve body 17 and the nozzle plate 21*n* form a nozzle part configured to inject fuel. The nozzle plate 21*n* in which the after-mentioned fuel injection holes 220 and passages 210 for swirl (horizontal passages 211 and swirl chambers 212) are formed is joined to the distal end surface of a nozzle part main body (valve seat member 15) at which the valve part 7 is formed.

A drive part 9 configured to drive the valve body 17 is disposed in the middle part of the cylindrical body 5. The drive part 9 is formed by an electromagnetic actuator. Specifically, the drive part 9 is formed of a fixed iron core 25, the movable element (movable member) 27, an electromagnetic coil 29 and a yoke 33.

The fixed iron core 25 is made of a magnetic metal material, and is press-fitted into and fixed to the inside of the middle part in the longitudinal direction of the cylindrical body 5. The fixed iron core 25 is formed in a cylindrical shape, and has a through hole 25*a* penetrating through the center part thereof in the direction along the central axis 1*a*. The fixed iron core 25 may be fixed to the cylindrical body 5 by welding, or may be fixed to the cylindrical body 5 by using welding with press-fitting.

In the inside of the cylindrical body 5, the movable element 27 is disposed on the distal end side with respect to the fixed iron core 25. A movable iron core 27*a* is provided on the base end side of the movable element 27. The movable iron core 27*a* faces the fixed iron core 25 via a minute gap 6. A small diameter part 27*b* is formed on the distal end side of the movable element 27, and the valve body 17 is fixed to the distal end of this small diameter part 27*b* by welding. In the present embodiment, although the movable iron core 27*a* and the small diameter part 27*b* are formed integrally with each other (one member made of the same material), they may be formed by joining two members. The movable element 27 is provided with the valve body 17, and displaces the valve body 17 in a valve opening/closing direction. The valve body 17 comes in contact with the valve seat member 15 and the outer circumferential surface of the movable iron core 27*a* comes in contact with the inner circumferential surface of the cylindrical body 5, and the movement of the movable element 27 in the direction along the central axis 1*a* (valve opening/closing direction) is guided by two points in a valve axial center direction.

A concave part 27*c* is formed on the end surface of the movable iron core 27*a* which faces the fixed iron core 25. A spring seat 27*e* of a spring (coil spring) 39 is formed on the bottom surface of the concave part 27*c*. A through hole 27*f* which penetrates to the end portion on the distal end side of the small diameter part (connection part) 27*b* is formed on the inner circumferential side of the spring seat 27*e* along the central axis 1*a*. In addition, an opening part 27*d* is formed on the side surface of the small diameter part 27*b*. The through hole 27*f* is opened to the bottom surface of the concave part 27*c* and the opening part 27*d* is opened to the outer circumferential surface of the small diameter part 27*b*, and a fuel flow passage 3 is formed which communicates a fuel flow passage 3 formed in the fixed iron core 25 with the valve part 7.

The electromagnetic coil 29 is fitted onto the outer circumferential side of the cylindrical body 5 at a position at which the fixed iron core 25 faces the movable iron core 27*a* via the minute gap 6. The electromagnetic coil 29 is wound around a cylindrical bobbin 31 made of a resin material, and is fitted onto the outer circumferential side of the cylindrical body 5. The electromagnetic coil 29 is electrically connected to a connector pin 43 disposed in a connector 41 via a wiring member 45. A drive circuit which is not shown in the drawings is connected to the connector 41, and drive current is fed to the electromagnetic coil 29 via the connector pin 43 and the wiring member 45.

The yoke 33 is made of a metal material having magnetism. The yoke 33 is disposed so as to cover the electromagnetic coil 29 on the outer circumferential side of the electromagnetic coil 29, and also serves as a housing for the fuel injection valve 1. In addition, the lower end part of the yoke 33 faces the outer circumferential surface of the movable iron core 27*a* via the cylindrical body 5, and the movable iron core 27*a*, the fixed iron core 25 and the yoke 33 form a closed magnetic path through which a magnetic flux generated by energizing the electromagnetic coil 29 flows.

The coil spring 39 is set over the through hole 25*a* of the fixed iron core 25 and the concave part 27*c* of the movable iron core 27*a* in a compressed state. The coil spring 39 functions as a biasing member for biasing the movable element 27 in the direction in which the valve body 17 comes in contact with the valve seat 15*b* (valve closing direction). An adjuster (adjusting element) 35 is disposed on the inner side of the through hole 25*a* of the fixed iron core 25, and the end portion on the base end side of the coil spring 39 comes in contact with the end surface on the distal end side of the adjuster 35. By adjusting the position of the adjuster 35 in the through hole 25*a* in the direction along the central axis 1*a*, the biasing force of the movable element 27 (that is, the valve body 17) by the coil spring 39 is adjusted.

The adjuster 35 has a fuel flow passage 3 penetrating through the center part of the adjuster 35 in the direction along the central axis 1*a*. After flowing through the fuel flow passage 3 of the adjuster 35, fuel flows through the fuel flow passage 3 at the distal end side part of the through hole 25*a* of the fixed iron core 25, and then flows through the fuel flow passage 3 formed inside the movable element 27.

An O-ring 46 is fitted onto the distal end part of the cylindrical body 5. The O-ring 46 functions as a seal for securing liquid-tightness and airtightness between the inner circumferential surface of an insertion port 109*a* (see FIG. 5) formed in an internal combustion engine side and the outer circumferential surface of the yoke 33, when the fuel injection valve 1 is attached to the internal combustion engine.

A resin cover 47 is molded in a range from the middle part to a part close to the end portion on the base end side of the fuel injection valve 1. The end portion on the distal end side of the resin cover 47 covers a part on the base end side of the yoke 33. In addition, the resin cover 47 covers the wiring member 45, and the connector 41 is integrally formed by the resin cover 47.

Next, operation of the fuel injection valve 1 will be explained.

When the electromagnetic coil 29 is in a non-energization state (that is, the drive current is not fed to the electromagnetic coil 29), the movable element 27 is biased in the valve closing direction by the coil spring 39, and the valve body 17 is in a state of being in contact with the valve seat 15*b* (seating state). In this case, the gap 6 exists between the end surface on the distal end side of the fixed iron core 25 and the end surface on the base end side of the movable iron core 27*a*. In the present embodiment, the distance of this gap 6 is equal to that of the stroke of the movable element 27 (that is, the valve body 17).

When the electromagnetic coil 29 is energized, and the drive current is fed to the electromagnetic coil 29, a magnetic flux is generated in the closed magnetic path formed by the movable iron core 27*a*, the fixed iron core 25 and the yoke 33. By this magnetic flux, magnetic attraction force is generated between the fixed iron core 25 and the movable iron core 27*a* which are opposed to each other with the gap 6 interposed therebetween. When this magnetic attraction force overcomes the resultant force of the biasing force by the coil spring 39 and fuel pressure acting on the movable element 27 in the valve closing direction, the movable element 27 starts moving in the valve opening direction. When the valve body 17 is separated from the valve seat 15*b*, a gap (fuel passage) is formed between the valve body 17 and the valve seat 15*b*, and fuel injection stars. In the present embodiment, when the movable element 27 moves by a distance equal to the gap 6 in the valve opening direction, and the movable iron core 27*a* comes in contact with the fixed iron core 25, the movement of the movable iron core 27*a* in the valve opening direction is stopped, and the valve is opened, and then it becomes a stationary state.

When the energization to the electromagnetic coil 29 is stopped, the magnetic attraction force is lowered, and then disappears. At this stage in which the magnetic attraction force is lowered, when the magnetic attraction force becomes smaller than the biasing force of the coil spring 39, the movable element 27 starts moving in the valve closing direction. When the valve body 17 comes in contact with the valve seat 15*b*, the valve part 7 is closed and the valve body 17 becomes a stationary state.

As mentioned above, the valve body 17 and the valve seat 15*b* cooperatively perform the opening/closing of the fuel passage on the upstream side of the fuel injection holes.

Figure 2:
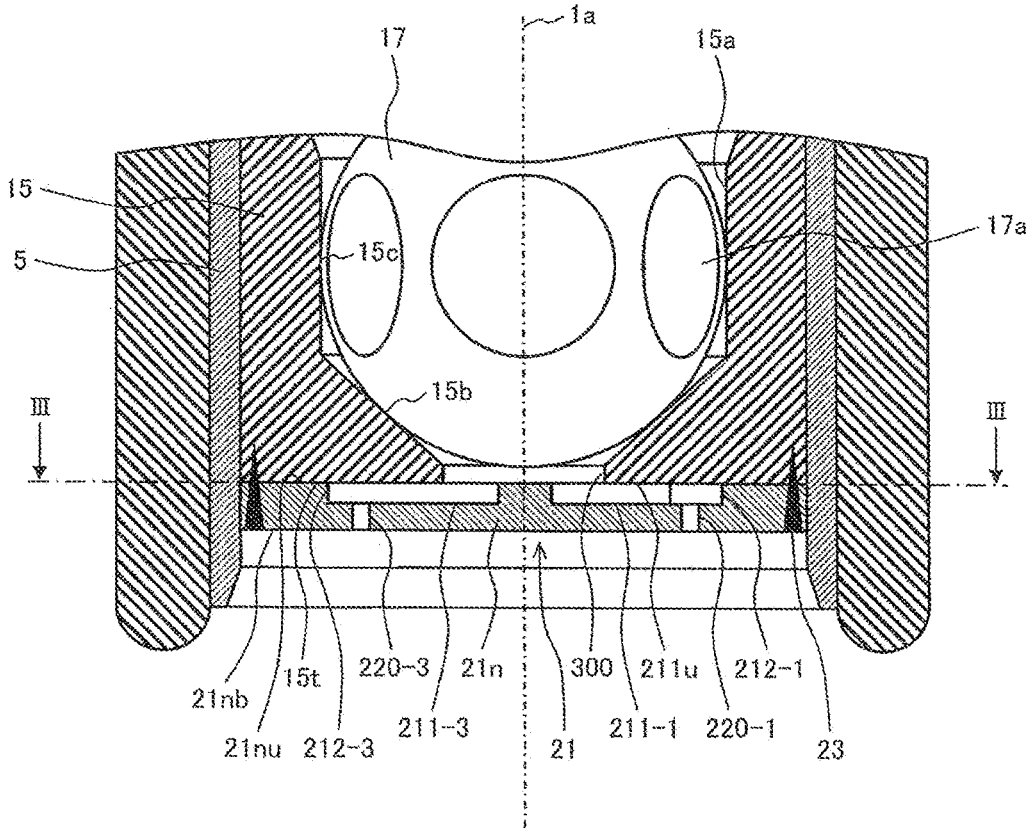
FIG. 2 is an enlarged sectional view (sectional view corresponding to a cross section when viewed from an arrow II-II of FIG. 3) showing the vicinity (nozzle part) of a valve part 7 and a fuel injection part 21 of the fuel injection valve 1 in FIG. 1.
Figure 3:
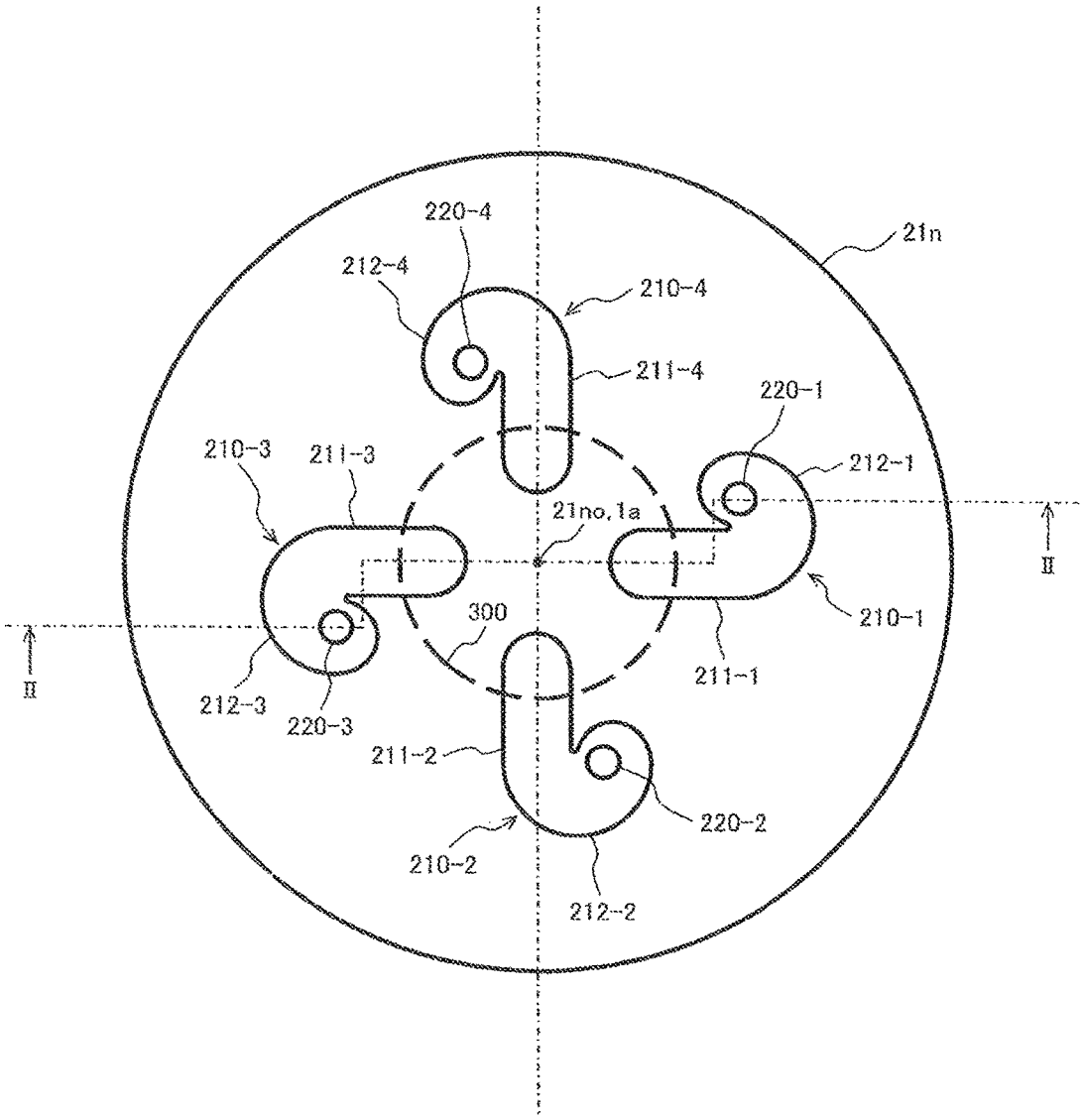
FIG. 3 is a plan view of a nozzle plate 21*n* when viewed from an arrow direction of FIG. 1.

Next, with reference to FIG. 2 and FIG. 3, the configuration of the valve part 7 and the fuel injection part 21 will be explained in detail. FIG. 2 is an enlarged sectional view (corresponding to a sectional view of FIG. 3 when viewed from an arrow II-II) of the vicinity (nozzle part) of the valve part 7 and the fuel injection part 21 of the fuel injection valve 1 in FIG. 1. FIG. 3 is a plan view of the nozzle plate 21*n* when viewed from an arrow direction of FIG. 1.

In addition, FIG. 3 is a plan view when the nozzle plate 21*n* is viewed from an inlet side of the fuel injection holes, and is a plan view on an upper end surface 21*nu* side of the nozzle plate 21*n*. This plan view is a drawing in which passages for swirl (fuel passages for swirl) 210-1, 210-2, 210-3 and 210-4, fuel injection holes 220-1, 220-2, 220-3 and 220-4 and a fuel inlet 300 are projected onto a plane perpendicular to the central axis 1*a*. The fuel inlet 300 is shown by a broken line. The upper end surface 21*nu* is a surface facing a distal end surface 15*t* of the valve seat member 15. The end surface on the opposite side to the upper end surface 21*nu* is referred as a lower end surface 21*nb*.

As shown in FIG. 2, in the present embodiment, the nozzle plate 21*n* is formed by a plate-shaped member whose both end surfaces are flat surfaces, and the upper end surface 21*nu* and the lower end surface 21*nb* are parallel to each other. That is, the nozzle plate 21*n* is formed by a flat plate having uniform thickness. In the present embodiment, as shown in FIG. 3, the nozzle plate 21*n* is configured such that the central axis 1*a* intersects the nozzle plate 21*n* at a center 21*no* of the nozzle plate 21*n*.

The distal end surface (lower end surface) 15*t* of the valve seat member 15 is formed by a flat surface (plane surface) perpendicular to the central axis 1*a*. The distal end surface 15*t* of the valve seat member 15 is joined with the nozzle plate 21*n*, and the distal end surface 15*t* comes in contact with the upper end surface 21*nu* of the nozzle plate 21*n*.

As shown in FIG. 3, the nozzle plate 21*n* is formed with the horizontal passages (horizontal fuel passages) 211-1, 211-2, 211-3 and 211-4, the swirl chambers (turning chambers) 212-1, 212-2, 212-3 and 212-4, and with the fuel injection holes 220-1, 220-2, 220-3 and 220-4.

The horizontal passages 211-1, 211-2, 211-3 and 211-4 and the swirl chambers 212-1, 212-2, 212-3 and 212-4 form the swirl passages 210-1, 210-2, 210-3 and 210-4 for applying swirling force to fuel on the upstream sides of the fuel injection holes 220.

The swirl chambers 212-1, 212-2, 212-3 and 212-4 are configured to allow fuel to flow into the fuel injection holes 220-1, 220-2, 220-3 and 220-4 respectively while swirling the fuel.

The horizontal passages 211-1, 211-2, 211-3 and 211-4 are fuel passages extending in a direction along the plate surface of the nozzle plate 21*n*, are connected on the upstream sides of the swirl chambers 212-1, 212-2, 212-3 and 212-4 respectively, and are configured to supply fuel to the swirl chambers 212-1, 212-2, 212-3 and 212-4 respectively.

In addition, the components of the swirl passages 210-1, 210-2, 210-3 and 210-4 in the present embodiment are different from those of the swirl passages in the patent document 2.

Four sets of the swirl passage 210-1 and the fuel injection hole 220-1, the swirl passage 210-2 and the fuel injection hole 220-2, the swirl passage 210-3 and the fuel injection hole 220-3 and the swirl passage 210-4 and the fuel injection hole 220-4 are each configured similarly, and without distinguishing them, they are explained as swirl passages 210, horizontal passages 211, swirl chambers 212 and fuel injection holes 220. In case where the configuration is changed in each of the sets, it will be explained appropriately.

As shown in FIG. 2, the valve seat member 15 is formed with the conical valve seat 15*b* whose diameter is reduced toward the downstream side. The downstream end of the valve seat 15*b* is connected to the fuel inlet 300. The downstream end of the fuel inlet 300 is opened to the distal end surface 15*t* of the valve seat member 15. The fuel inlet 300 forms a fuel passage for introducing fuel to the swirl passages 210.

The swirl passages 210 are provided such that the end portions on the upstream sides of the horizontal passages 211 face the opening surface of the fuel inlet 300 to receive fuel supply from the fuel inlet 300. In the present embodiment, as shown in FIG. 3, four sets of the horizontal passages 211-1, 211-2, 211-3 and 211-4 are independently configured, and the end portions (end portions on the inlet sides) on the upstream sides of the horizontal passages 211-1, 211-2, 211-3 and 211-4 are separated from each other inside the nozzle plate 21*n*.

In FIG. 2, the nozzle plate 21*n* formed by one plate-shaped member is formed with all of the horizontal passages 211, the swirl chambers 212 and the fuel injection holes 220. For example, the nozzle plate 21*n* can be formed by a plurality of plates by dividing it in a thickness direction. For example, the horizontal passages 211 and the swirl chambers 212 are formed to one plate, and the fuel injection holes 220 are formed to the other plate, and the nozzle plate 21*n* can be formed by stacking these two plates.

In addition, in the present embodiment, as shown in FIG. 2, although the fuel injection holes 220 are formed parallel to the central axis 1*a*, they can be inclined at an angle larger than 0° with respect to the central axis 1*a*. Moreover, they can be formed so as to inject fuel in a plurality of directions by making a difference in inclination direction.

In the present embodiment, as shown in FIG. 3, the swirl passage 210-1 and the fuel injection hole 220-1 form one fuel passage, the swirl passage 210-2 and the fuel injection hole 220-2 form one fuel passage, the swirl passage 210-3 and the fuel injection hole 220-3 form one fuel passage, and the swirl passage 210-4 and the fuel injection hole 220-4 form one fuel passage. The swirl passage 210-1 is formed of the horizontal passage 211-1 and the swirl chamber 212-1, the swirl passage 210-2 is formed of the horizontal passage 211-2 and the swirl chamber 212-2, the swirl passage 210-3 is formed of the horizontal passage 211-3 and the swirl chamber 212-3, and the swirl passage 210-4 is formed of the horizontal passage 211-4 and the swirl chamber 212-4.

In the embodiment, in total, four sets of the fuel passages formed of the swirl passages 210 and the fuel injection holes 220 are formed in the nozzle plate 21*n*. Each of the four sets of the fuel passages is formed radially outward from the center 21*no* side of the nozzle plate 21*n* toward outside. That is, the horizontal passages 211 are provided radially outward from the center 21*no* side of the nozzle plate 21 toward outside and extend in the radial direction of the nozzle plate 21*n*. In addition, the fuel passages are formed circumferentially so as to be spaced from one another at an angle interval of 90°. Moreover, in the four sets of the swirl passages 210, each of the end portions on the upstream sides of the horizontal passages 211 is provided at an equal distance from the center 21*no* of the nozzle plate 21*n*.

The number of the sets of the swirl passages 210 and the fuel injection holes 220 is not limited to four, and it can be two or three, or five or more.

Figure 4:
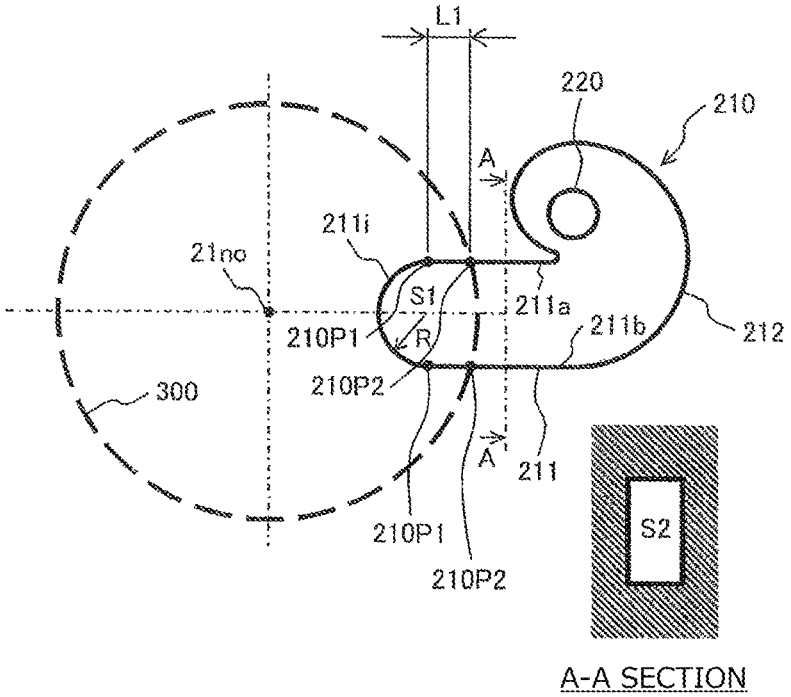
FIG. 4 is a plan view showing the relationship between a passage 210 for swirl and a fuel inlet 300.

Here, with reference to FIG. 4, the relation between the swirl passages 210 and the fuel inlet 300 will be explained. FIG. 4 is a plan view showing the relation between a swirl passage 210 and the fuel inlet 300. This plan view is a drawing in which a swirl passage 210, a fuel injection hole 220 and the fuel inlet 300 are projected onto a plane perpendicular to the central axis 1*a*.

A horizontal passage 211 is connected to a swirl chamber 212 so as to be offset with respect to the center of the swirl chamber 212. The inner circumferential wall (side wall) of the swirl chamber 212 is formed such that the curvature thereof becomes gradually large from the upstream side toward the downstream side in a flow direction of a swirling fuel. The inner circumferential wall (side wall) of the swirl chamber 212 can be formed with a fixed curvature from the upstream side toward the downstream side in the flow direction of the swirling fuel.

In the present embodiment, side wall sections (side-section side surfaces) 211*a* and 211*b* of the horizontal passage 211 is formed to extend linearly from the upstream side toward the downstream side. A side wall section (end-section side surface) 211*i* of the end portion on the upstream side of the horizontal passage 211 is formed in a curved shape that is curved in the plane shown in FIG. 4. In particular, in the present embodiment, the side wall section 211*i* is formed by a curve in a shape of a circular arc, and has a semicircular shape.

That is, in the horizontal passage 211, two side surfaces (side-section side surfaces) 211*a* and 211*b* extending along the fuel flow direction have a linear section, and the side wall section 211*i* formed between the two side-section side surfaces 211*a* and 211*b* on the upstream side has a curved section connected to the linear section of the side-section side surfaces 211*a* and 211*b*.

This side wall section 211*i* is connected to the side-section side surfaces 211*a* and 211*b* at the place shown by a point 210P1. The side wall section 211*i* is formed with a fixed curvature (that is, a fixed curvature radius R) in a range between the end portion of the side wall section 211*i* which is connected to the side-section side surface 211*a* and the end portion of the side wall section 211*i* which is connected to the side-section side surface 211*b*. In addition, in the present embodiment, the side-section side surface 211*a* and the side-section side surface 211*b* of the horizontal passage 211 are parallel to each other from the upstream end side to the downstream end side. The diameter of the semicircle forming the side wall section 211*i* is therefore equal to the distance between the side-section side surface 211*a* and the side-section side surface 211*b*, that is, equal to the passage width of the horizontal passage 211.

In addition, for example, the side-section side surface 211*a* and the side-section side surface 211*b* can be formed such that the distance therebetween decreases or increases from the upstream end side toward the downstream end side.

The fuel inlet 300 is formed in a circular shape having a center on the central axis 1*a* of the valve. That is, the passage sectional shape of the fuel inlet 300 has a circular shape. In a plan view of FIG. 4, the opening edge (broken line part shown by a reference number 300) of the fuel inlet 300 intersects the side-section side surfaces 211*a* and 211*b* of the horizontal passage 211 at the place (point) shown by a reference sing 210P2. That is, the place 210P2 shows a place at which the projection of the opening edge of the fuel inlet 300 intersects the projection of the side-section side surfaces 211*a* and 211*b*.

In this way, when the fuel inlet 300 and the horizontal passage 211 are projected onto a plane perpendicular to the central axis 1*a* of the valve, the projected line of the linear section of the side-section side surfaces 211*a* and 211*b* of the horizontal passage 211 extends to the place intersecting the projected line of the opening edge of the fuel inlet 300, and the upstream-side end portion of the horizontal passage 211 extends toward the inside of the opening edge.

Moreover, in the present embodiment, a distance dimension L1 which is substantially larger than 0 (zero) is provided between the point 210P1 and the point 210P2. The distance dimension L1 of each of a plurality of the horizontal passages 211-1, 211-2, 211-3 and 211-4 may be different from each other. However, each of the all horizontal passages 211-1, 211-2, 211-3 and 211-4 has the distance dimension L1 substantially larger than 0 (zero).

Figure 5:
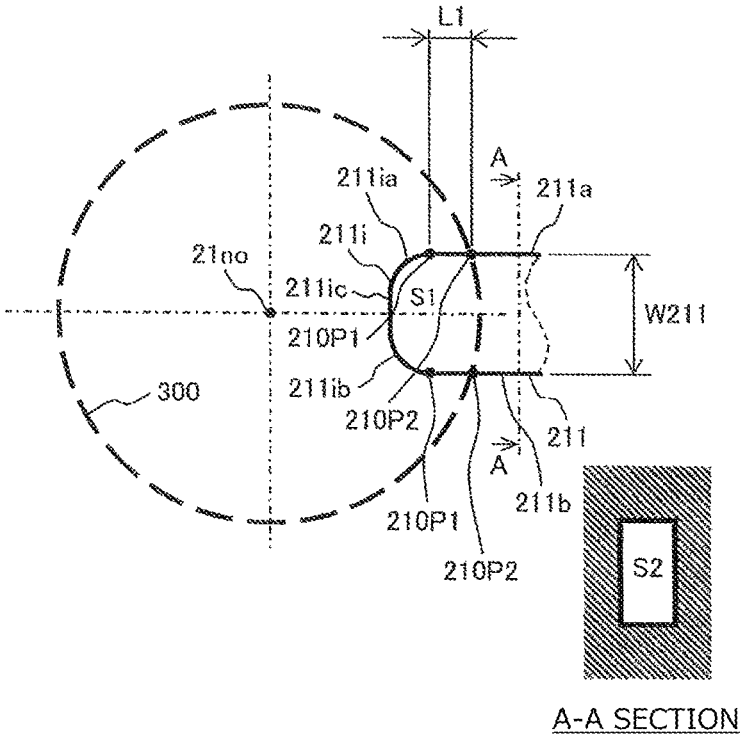
FIG. 5 is a plan view showing a variation of the shape of the inlet side end portion (end portion on the upstream side) of a horizontal passage 211.

In a plan view shown in FIG. 4, a passage sectional area S1 of the inlet opening surface of the horizontal passage 211 facing the fuel inlet 300 is larger than a passage sectional area (passage sectional area in a section taken along a line A-A of FIG. 5) S2 of the horizontal passage 211 on its downstream side. In the present embodiment, in a part at which the side-section side surfaces 211*a* and 211*b* of the horizontal passage 211 form a linear shape, the passage sectional area S2 has a fixed size from the upstream end toward the downstream end. In case where the passage sectional area S2 is changed, the passage sectional area S1 is set so as to have a value (area) larger than the maximum value of the passage sectional area S2. In addition, the passage sectional area S1 is a sectional area perpendicular to the valve axial center (central axis) la, and the passage sectional area S2 is a sectional area perpendicular to the extending direction (direction along fuel flow) of the horizontal passage 211.

FIG. 5 is a plan view showing a variation of the shape of the end portion on the inlet side (end portion on the upstream side) of the horizontal passage 211.

The side wall section 211*i* of the upstream-side end portion of the horizontal passage 211 is not necessary to have a semicircular shape, and, for example, it may has a shape in which a linear section 211*ic* connects a curved section 211*ia* connected to the side-section side surface 211*a* and a curved section 211*ib* connected to the side-section side surface 211*b*. That is, it may have a shape in which the linear section 211*ic* is connected to the side-section side surfaces 211*a* and 211*b* by chamfered sections having rounded shapes, or may have another shape. However, the horizontal passage 211 is configured on the premise that the side-section side surfaces 211*a* and 211*b* are formed in a linear shape and a shape section in which a passage width W211 decreases toward the upstream side is included on the upstream sides of the side-section side surfaces 211*a* and 211*b*.

In the present variation, only the shapes of the curved section 211*ia*, the curved section 211*ib* and the linear section 211*ic* are different from those of the above-mentioned embodiment, and the other configuration is formed similar to the above-mentioned embodiment.

The fuel inlet 300 is formed in the valve seat member 15, and the swirl passages 210 are formed in the nozzle plate 21*n*. In case where the valve seat member 15 and the nozzle plate 21*n* are accurately machined without an error, and both of them are accurately attached to each other without an error, the passage sectional areas S1 of a plurality of the swirl passages 210 are equal to each other. However, when an error occurs in the machining of the valve seat member 15 and the nozzle plate 21*n*, or when an error occurs in the attachment of them, the passage sectional areas S1 of a plurality of the swirl passages 210 are different in each of the swirl passages 210, and the amount of fuel flow distributed into each of the swirl passages 210 becomes different.

Figure 6:
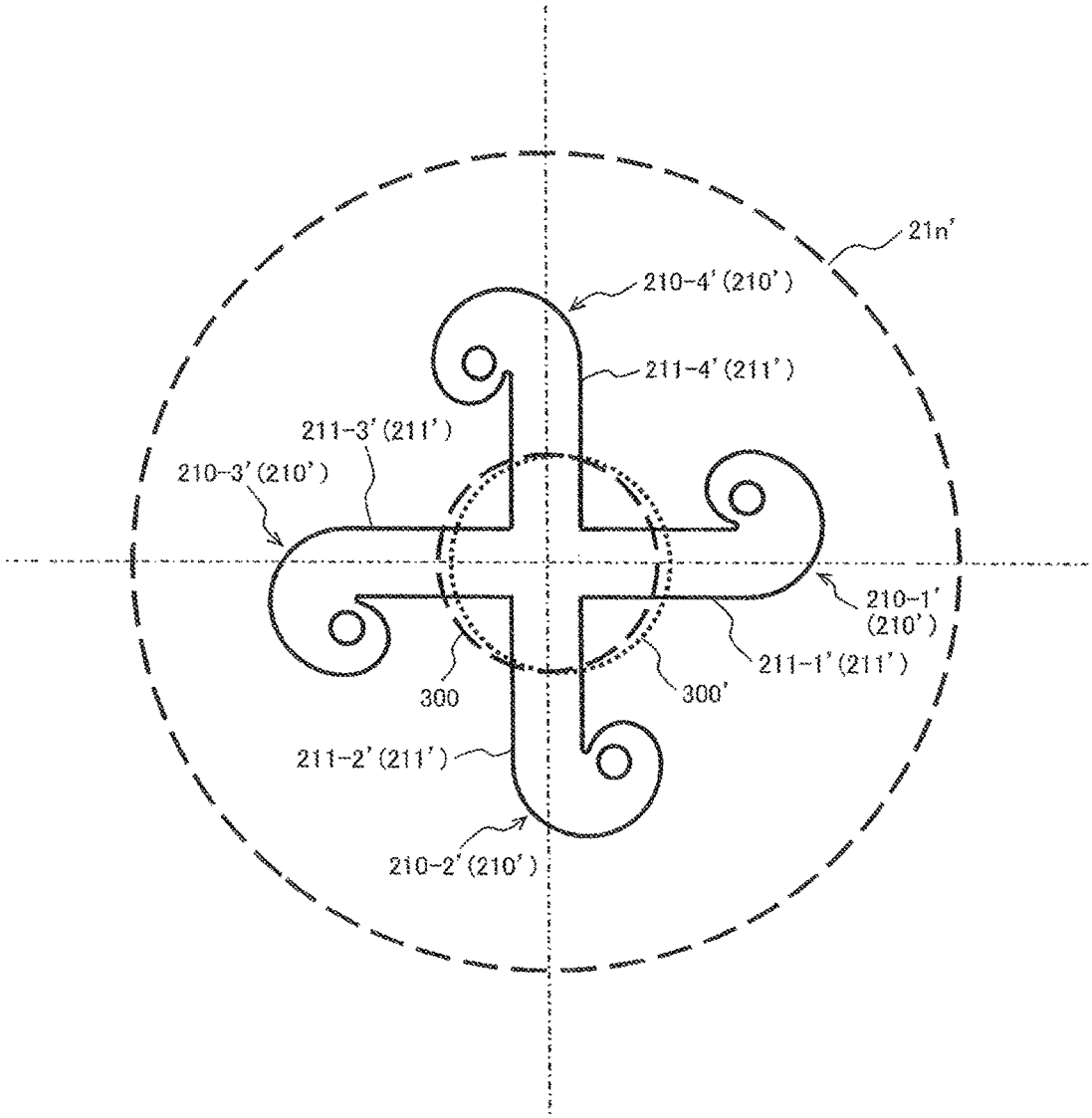
FIG. 6 is a plan view to explain a problem in a configuration (comparative embodiment with respect to the present embodiment) in which a plurality of swirl passages 210 are connected in the center part of a nozzle plate 21*n'*.
Figure 7:
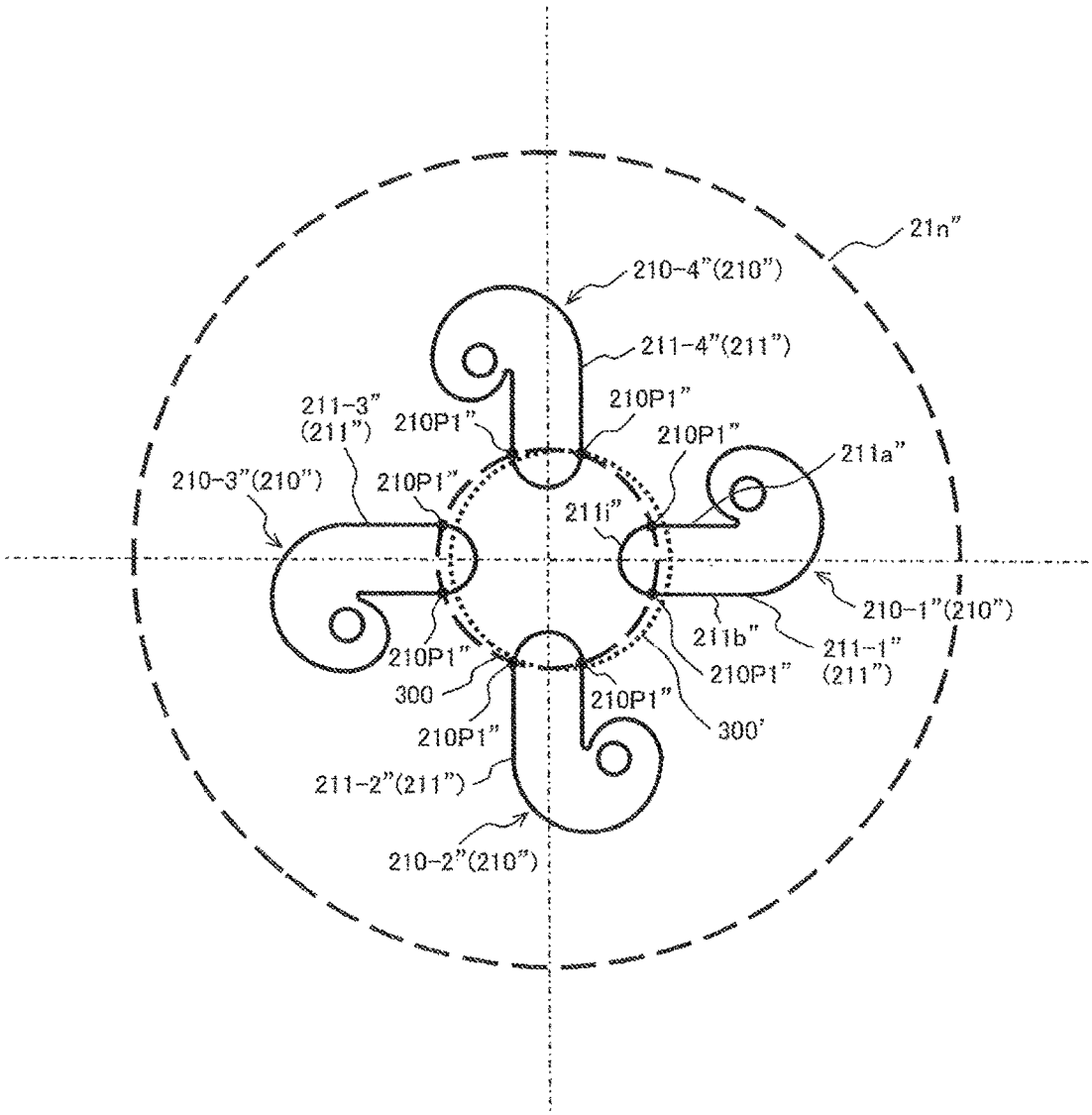
FIG. 7 is a plan view to explain a problem in a configuration (comparative embodiment with respect to the present embodiment) in which a plurality of swirl passages 210" are provided independently from each other.

With reference to FIG. 6 and FIG. 7, an influence of a positional deviation between the valve seat member 15 and the nozzle plate 21*n* will be explained.

FIG. 6 shows a plan view to explain a problem in the configuration (comparative embodiment with respect to the present embodiment) in which a plurality of swirl passages 210 are joined in the center part of a nozzle plate 21*n'*.

In this comparative embodiment, four sets of horizontal passages 211' (211-1', 211-2', 211-3', 211-4') of swirl passages 210' (210-1', 210-2', 210-3', 210-4') are connected in the vicinity of the center of the nozzle plate 21*n'*. Therefore the passage length of the horizontal passages 211' becomes long, and the dead volume of the fuel passage formed on the downstream side of the valve seat becomes large. However, in this comparative embodiment, even if a positional deviation occurs between the valve seat member 15 in which the fuel inlet 300 is formed and the nozzle plate 21*n'* in which the swirl passages 210' are formed, and the fuel inlet 300 deviates to a position shown by a dotted line 300' with respect to the nozzle plate 21*n'*, it is possible to equally distribute fuel to the swirl passages 210' through the connection part of each of the swirl passages 210' which is located on the center part of the fuel inlet 300.

FIG. 7 is a plan view to explain a problem in the configuration (comparative embodiment with respect to the present embodiment) in which a plurality of swirl passages 210" are formed independently from each other.

In this comparative embodiment, four sets of horizontal passages 211" (211-1", 211-2", 211-3" and 211-4") of swirl passages 210" (210-1", 210-2", 210-3" and 210-4") are formed independently from each other on a nozzle plate 21*n"*. However, the opening edge (broken line part shown by a reference number 300) of the fuel inlet 300 intersects side wall sections 211*a"*, 211*b"* and 211*i"* of each of the horizontal passages 211" at a connection place 210P1" of the side wall sections 211*a"* and 211*b"* having a linear shape and the side wall sections 211*i"* having a curved shape of each of the horizontal passages 211". That is, the distance dimension L1 explained in FIG. 4 is 0 (zero).

In this case, positional deviation occurs between the valve seat member 15 in which the fuel inlet 300 is formed and the nozzle plate 21*n"* in which the swirl passages 210" are formed, and when the fuel inlet 300 deviates to a position shown by a dotted line 300' relative to the nozzle plate 21*n"*, in the swirl passages 210-2", 210-3" and 210-4", the opening edge of the fuel inlet 300 intersects the side wall sections 211*i"* having curved shapes of the horizontal passages 211". In the swirl passages 210-2", 210-3" and 210-4", when positional deviation occurs between the valve member 15 and the nozzle plate 21*n"*, the position of the opening edge of the fuel inlet 300 is shifted in the region in which the side wall sections 211*i"* of the horizontal passages 211" are formed. In this case, as compared with a case where the opening edge position of the fuel inlet 300 is shifted in the side wall sections 211*a"* and 211*b"* of the horizontal passages 211", the rate of change of the passage sectional area of each of the horizontal passage 211" which faces the fuel inlet 300 to the amount of the positional deviation between the valve seat member 15 and the nozzle plate 21*n"* becomes large. Consequently, variation in the flow amount of fuel which flows to a plurality of the swirl passages 210" becomes large.

In the present embodiment, as explained in FIG. 4, by configuring the opening edge (a broken line part shown by a reference number 300) of the fuel inlet 300 so as to intersect the linear-shaped side wall sections 211*a* and 211*b* of the horizontal passages 211, even if positional deviation occurs between the valve seat member 15 and the nozzle plate 21*n*, the rate of change of the passage sectional area of each of the horizontal passages 211 which faces the fuel inlet 300 can be small. That is, the rate of change of the facing surface area in each of the horizontal passages 211 which faces the fuel inlet 300 can be small. As this result, it is possible to evenly distribute fuel to a plurality of the swirl passages 210 formed in the nozzle plate 21*n*, and thereby variation in in the flow amount of fuel flowing through each of the swirl passages 210 can be small.

In the present embodiment, in case where the severest design is performed in consideration of the positional deviation between the valve seat member 15 and the nozzle plate 21*n*, there is a case where the distance dimension L1 explained in FIG. 4 becomes 0 (zero) in at least one swirl passage 210. On the other hand, in at least one swirl passage 210, a distance dimension L1 substantially larger than 0

(zero) exists between the point P1 and the point P2. In addition, the distance dimension L1 between the point 210P1 and the point 210P2 has a value equal to 0 (zero) or larger in each of all of the swirl passages 210.

That is, in a plurality of the swirl passages 210 in the present embodiment, all of the swirl passages 210-1 to 210-4 each have a distance dimension L1 equal to 0 or larger between the connection place 210P1 that is a connection place of the side-section side surfaces (linear section) 211*a* and 211*b* and the end portion side surface (curved section) 211*i* and the intersection place 210P2 of the projected line of the opening edge of the fuel inlet and the projected line of the linear section. Moreover, at least one swirl passage has a distance dimension L1 larger than 0 between the connection place 210P1 that is a connection place of the side-section side surfaces 211*a* and 211 *b* and the curved section 211*i* and the intersection place 210P2 of the projected line of the opening edge of the fuel inlet and the projected line of the linear section.

All of a plurality of the horizontal passages 221-1 to 211-4 each have the distance dimension L1 larger than 0 between the connection place 210P1 and the intersection place 210P2, and consequently, it is possible to allow for a margin of machining accuracy of the nozzle plate 12*n* and the valve seat member 15, and to allow for a margin of assembling accuracy in an assembling process between the nozzle plate 21*n* and the valve member 15.

In addition, by setting the size of the passage sectional area S1 to be larger than that of the passage sectional area S2, fuel can be distributed into each of the swirl passages 210, and thereby variation in the flow amount of the fuel flowing to each of the swirl passages 210 can be small.

In the present embodiment, a configuration has been explained in which the horizontal passages 211 are provided radially outward from the center 21*no* side of the nozzle plate 21*n* toward outside. Other than this configuration, a configuration may be applied, configuration in which the horizontal passages 211 extend from the outer circumferential side of the nozzle plate 21*n* toward the center 21*n*, and the swirl chambers 212 are connected to the end portions of the horizontal passages 211 located at the center 21*no* side of the nozzle plate 21*n*. In this case, it is also configured such that the relation between the point 210P1, the point 210P2 and the distance dimension L1 explained in FIG. 4 is applied to the connection state between the opening part (fuel inlet 300) of the valve seat member 15 for introducing fuel into the horizontal passages 211 and the horizontal passages 211.

Figure 8:
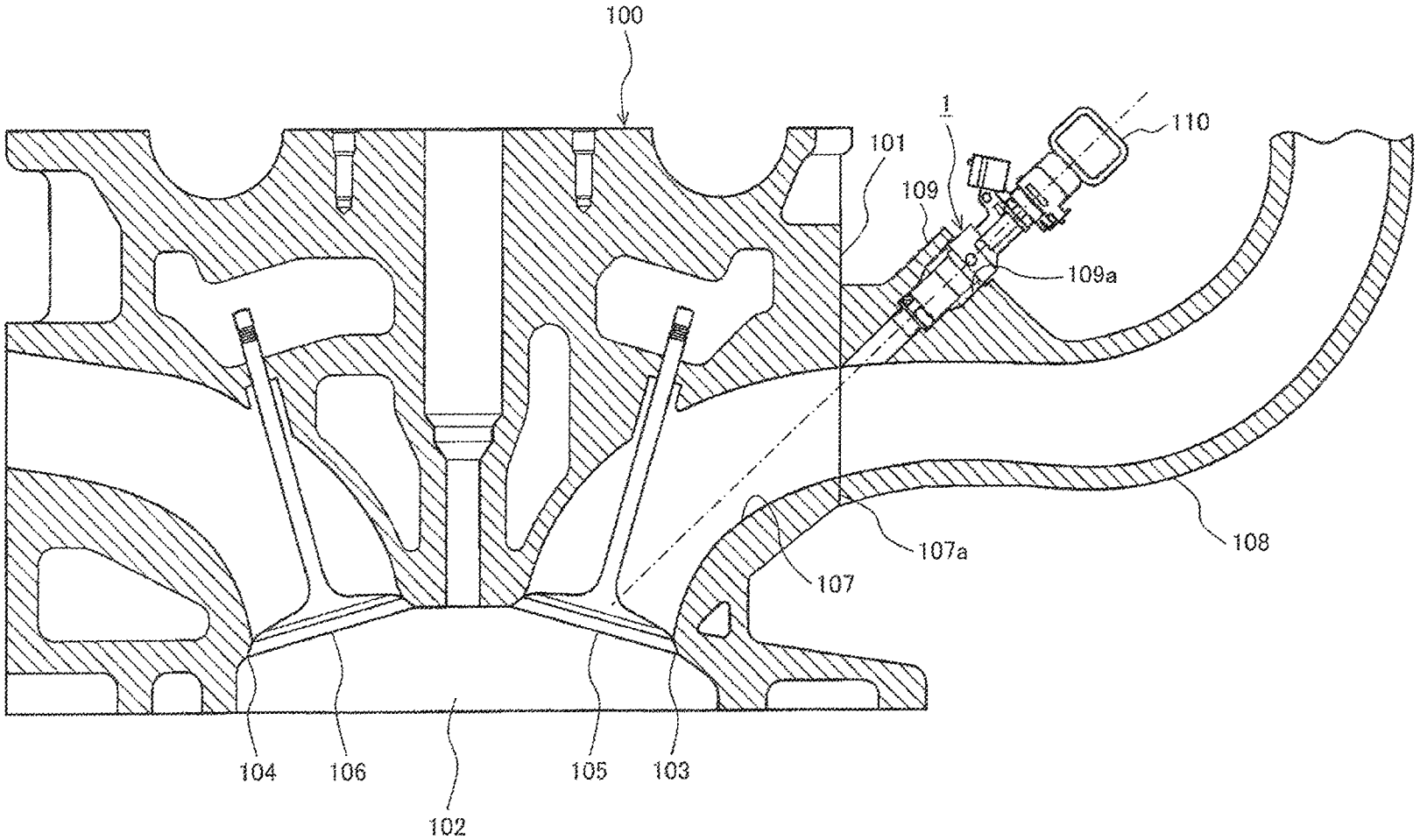
FIG. 8 is a sectional view of an internal combustion engine on which the fuel injection valve 1 is mounted.

An internal combustion engine on which a fuel injection valve according to the present invention is mounted will be explained with reference to FIG. 8. FIG. 8 is a sectional view of the internal combustion engine on which the fuel injection valve 1 is mounted.

An engine block 101 of an internal combustion engine 100 is formed with a cylinder 102, and an intake port 103 and an exhaust port 104 are provided at the top part of the cylinder 102. The intake port 103 is provided with an intake valve 105 that opens and closes the intake port 103, and the exhaust port 104 is provided with an exhaust valve 106 that opens and closes the exhaust port 104. An intake pipe 108 is connected to an inlet side end part 107*a* of an intake flow passage 107 communicating to the intake port 103.

A fuel pipe 110 is connected to the fuel supply port 2 (see FIG. 1) of the fuel injection valve 1.

The intake pipe 108 is formed with an attaching part 109 for the fuel injection valve 1, and the attaching part 109 is formed with an insertion port 109*a* into which the fuel injection valve 1 is inserted. The insertion port 109*a* penetrates to the inner wall surface of the intake pipe 108 (intake flow passage), and the fuel injected from the fuel injection valve 1 inserted into the insertion port 109*a* is injected into the intake flow passage. In a case of two-directional spray, in an internal combustion engine in which two intake ports 103 are provided in the engine block 101, fuel injection sprays are injected toward the respective intake ports 103 (intake valves 105).

In addition, the present invention is not limited to the above embodiment or variation, and a part of the configuration can be deleted and another configuration which is not described can be added. Moreover, the configurations described in the explanation of the above-mentioned embodiment and variation can be exchanged and added between the embodiment and the variation.

As a fuel injection valve based on the embodiment explained above, for example, the following aspects can be considered.

In a preferable aspect, a fuel injection valve includes: fuel injection holes configured to inject fuel to an outside; a valve body configured to open and close a fuel passage in cooperation with a valve seat, on upstream sides of the fuel injection holes; a valve seat member formed with the valve seat; and a nozzle plate in which a plurality of swirl passages are formed and which is connected to a distal end surface of the valve seat member, wherein the swirl passages each include: a swirl chamber for allowing fuel to be swirled to flow to a corresponding one of the fuel injection holes; and a horizontal passage which is connected to an upstream side of the swirl chamber and which supplies fuel to the swirl chamber, wherein the valve seat member is opened to the distal end surface to which the nozzle plate is connected and includes a fuel inlet which is connected to an upstream-side end portion of the horizontal passage and introduces fuel into the plurality of the swirl passages, wherein the horizontal passage includes two side-section side surfaces extending along a fuel flow direction and having a linear section, and includes, on an upstream side thereof, an end-section side surface which is formed between the two side-section side surfaces and which has a curved section connected to the linear section, wherein when the fuel inlet and the horizontal passage are projected onto a plane perpendicular to a valve axial center, a projected line of the linear section of the side-section side surfaces of the horizontal passage extends to a place intersecting a projected line of an opening edge of the fuel inlet, and the upstream-side end portion of the horizontal passage extends toward an inside of the opening edge, and wherein, in the plurality of the swirl passages, all of the swirl passages each have a distance dimension equal to 0 or larger between a connection place of the linear section and the curved section and the intersection place of the projected line of the opening edge of the fuel inlet and the projected line of the linear section, and at least one of the swirl passages has a distance dimension larger than 0 between the connection place of the linear section and the curved section and the intersection place of the projected line of the opening edge of the fuel inlet and the projected line of the linear section.

In a preferable aspect of the fuel injection valve, a passage sectional area of the horizontal passage facing the fuel inlet and connected to the fuel inlet is larger than a passage sectional area formed at the linear section of the side-section side surfaces of the horizontal passage of each of the swirl passages.

In another preferable aspect, in any of the aspects of the fuel injection valve, a shape of the fuel inlet which is projected onto the plane is a circular shape, and the upstream-side end portions of a plurality of the horizontal passages forming the plurality of the respective swirl passages are located at an equal distance from a center of the nozzle plate.

In another preferable aspect, in any of the aspects of the fuel injection valve, all of the plurality of the swirl passages each have the distance dimension larger than 0 between the connection place and the intersection place.

In another preferable aspect, in any of the aspects of the fuel injection valve, the curved section formed at the end-section side surface of each of the horizontal passages has a semicircular shape which connects the two side-section side surfaces.

The invention claimed is:

1. A fuel injection valve, comprising:

fuel injection holes configured to inject fuel to an outside;

a valve body configured to open and close a fuel passage in cooperation with a valve seat, on upstream sides of the fuel injection holes;

a valve seat member formed with the valve seat; and a nozzle plate in which a plurality of swirl passages are formed and which is connected to a distal end surface of the valve seat member, wherein the swirl passages each include:

a swirl chamber for allowing fuel to be swirled to flow to a corresponding one of the fuel injection holes; and a horizontal passage which is connected to an upstream side of the swirl chamber and which supplies fuel to the swirl chamber, wherein the valve seat member is opened to the distal end surface to which the nozzle plate is connected and includes a fuel inlet which is connected to an upstream-side end portion of the horizontal passage and introduces fuel into the plurality of the swirl passages, wherein the horizontal passage includes two side-section side surfaces extending along a fuel flow direction and having a linear section, and includes, on an upstream side thereof, an end-section side surface which is formed between the two side-section side surfaces and which has a curved section connected to the linear section, wherein when the fuel inlet and the horizontal passage are projected onto a plane perpendicular to a valve axial center, the horizontal passage is formed such that a projected line of the linear section of the side-section side surfaces or a connection place of the linear section and the curved section intersects a projected line of an opening edge of the fuel inlet, and wherein a passage sectional area of the horizontal passage facing the fuel inlet and connected to the fuel inlet is larger than a passage sectional area formed at the linear section of the side-section side surfaces of the horizontal passage of each of the swirl passages.

2. The fuel injection valve according to claim 1, wherein a shape of the fuel inlet which is projected onto the plane is a circular shape, and wherein the upstream-side end portions of a plurality of the horizontal passages forming the plurality of the respective swirl passages are located at an equal distance from a center of the nozzle plate.

3. The fuel injection valve according to claim 1, wherein the curved section formed at the end-section side surface of each of the horizontal passages has a semicircular shape which connects the two side-section side surfaces.

4. The fuel injection valve according to claim 1, wherein a distance dimension between the connection place of the linear section and the curved section and an intersection place of the projected line of the opening edge of the fuel inlet and the projected line of the linear section is allowed to be 0.

* * * * *